US006125864A

United States Patent [19]

Morikawa et al.

[11] Patent Number: 6,125,864

[45] Date of Patent: Oct. 3, 2000

[54] METHOD OF CLEANING INTERIOR OF CONTAINER, AND APPARATUS THEREFOR

[75] Inventors: Masao Morikawa, Sodegaura; Yoshio Iino, Ichihara, both of Japan

[73] Assignee: Sumitomo Chemical Company, Limited, Osaka, Japan

[21] Appl. No.: 08/973,699

[22] PCT Filed: Jun. 6, 1996

[86] PCT No.: PCT/JP96/01532

§ 371 Date: Dec. 8, 1997

§ 102(e) Date: Dec. 8, 1997

[87] PCT Pub. No.: WO96/41688

PCT Pub. Date: Dec. 27, 1996

[30] Foreign Application Priority Data

Jun. 8, 1995 [JP] Japan ..... 7-141630

[51] Int. Cl.[7] ..... B08B 9/08

[52] U.S. Cl. ..... 134/167 R; 134/181; 134/198

[58] Field of Search ..... 134/167 R, 162, 134/172, 166 R, 180, 153, 152, 169 R, 168 R, 176, 104.2, 181, 198; 239/264, 263.3

[56] References Cited

U.S. PATENT DOCUMENTS

| | | | |
|---|---|---|---|
| 1,954,222 | 4/1934 | Olson | 134/167 R |
| 3,688,782 | 9/1972 | Smith | 134/167 R |
| 3,856,570 | 12/1974 | Mcdermott | 134/167 R |
| 4,827,563 | 5/1989 | Gordon | 134/167 R |
| 5,346,141 | 9/1994 | Kim et al. | 241/5 |
| 5,579,787 | 12/1996 | Wood | 134/22.1 |
| 5,617,886 | 4/1997 | Mathieus | 134/172 |
| 5,706,842 | 1/1998 | Caimi et al. | 134/113 |

FOREIGN PATENT DOCUMENTS

| | | | |
|---|---|---|---|
| 759830 | 2/1934 | France | 134/167 R |

*Primary Examiner*—Frankie L. Stinson
*Attorney, Agent, or Firm*—Pillsbury Madison & Sutro LLP

[57] ABSTRACT

An apparatus for cleaning an interior of a container. The apparatus 10 includes a container base 20 for supporting a container 12 to be cleaned, a cleaning nozzle 36 composed of an elongated rigid pipe 38 and a nozzle head 40 with numerous injection holes 48 and fixed to one end of the pipe 38, a moving means 74 for moving the cleaning nozzle 36 linearly and reciprocally along the longitudinal axis of said cleaning nozzle 36, and a rotating means 58 for rotating the cleaning nozzle 36 about the longitudinal axis in clockwise and counterclockwise directions alternately. Further, the cleaning nozzle 36 is positioned so that the nozzle head 40 can be inserted into the container 12 through the opening 16 when said cleaning nozzle 36 is moved by said moving means. In this apparatus 10, the alternative rotation and reciprocally linear motion of the nozzle head 40 can be carried out simultaneously while the cleaning liquid is injected from the nozzle head 40 of the cleaning nozzle 36.

13 Claims, 5 Drawing Sheets

METHOD OF CLEANING INTERIOR OF CONTAINER, AND APPARATUS THEREFOR

TECHNICAL FIELD

The present invention relates to an apparatus and a method for cleaning the interior of a container.

BACKGROUND ART

Chemicals, used in electronic industries such as semiconductor manufacture, include those of liquid state such as sulfuric acid and hydrogen peroxide. The demand for low concentration of impurity particles contained in these chemicals as a quality thereof is becoming stronger in these years due to the trend of micropattern and higher density of integrated circuits. A conventional method for satisfying this demand is to remove the impurity particles from the chemicals by filtering the chemicals minutely. However, even if the chemicals for electronic industries are filtered minutely, in some cases the concentration of the impurity particles in the chemicals at the place of use increases after they are infused into containers and transported to the place of use, and it is regarded as caused by the particles existing in the interior of containers.

The interior of the container is, of course, cleaned before infusing the chemicals into the same. Water-jet method using a rotary nozzle head is employed conventionally for cleaning the interior of the container. The rotary nozzle head with numerous cleaning liquid injection holes is rotatably attached to an end of a comparatively rigid pipe and rotated by the pressure of the cleaning liquid, typically ultra-pure water, introduced from the other end of the pipe. Therefore, an efficient cleaning is carried out since the injected ultra-water strikes against the entire inner surface of the container as moving a rotary nozzle head inserted into the container reciprocally between the opening portion and the bottom portion of the container while the ultra-pure water is injected from the injection holes of the rotary nozzle head. However, there is a fact that a very small amount of the particles still remain in the container even if the cleaning with ultra-pure water using the rotary nozzle head is carried out for a long time.

SUMMARY OF INVENTION

Therefore, an object of the present invention is to provide a cleaning apparatus and method enable to make the entire interior of a container extremely clean with a comparatively small amount of cleaning liquid.

The present inventors examined the fact described above and found that, in the conventional method, since a rotary portion of the nozzle head is exposed to the passage of cleaning liquid, the cleaning liquid is contaminated by the small particles generated from the friction of said rotary portion, thus the container is contaminated. The present invention has been made based on these findings to provide a method of cleaning an interior of a container using a cleaning nozzle which comprises an elongated rigid pipe and a nozzle head with numerous injection holes and securely fixed to one end of the pipe. This cleaning method includes cleaning the interior of the container with a cleaning liquid injected from the injection holes of the nozzle head, comprising the steps of inserting the cleaning nozzle into the container from an opening of the container thereby locating the nozzle head inside the container, supplying the cleaning liquid from the other end of the pipe and injecting the liquid as a jet flow from the injection holes of the nozzle head, and moving the cleaning nozzle linearly and reciprocally along the longitudinal axis thereof and rotating the cleaning nozzle in clockwise and counterclockwise directions alternatively about the longitudinal axis.

Further, in another aspect, the present invention provides an apparatus for cleaning the interior of a container comprising a container base for supporting the container; a cleaning nozzle composed of an elongated rigid pipe and a nozzle head with numerous injection holes and fixed to an end of the pipe; a moving means for moving the cleaning nozzle linearly and reciprocally along the longitudinal axis thereof; and a rotating means for rotating the cleaning nozzle in clockwise and counterclockwise directions alternatively about the longitudinal axis, wherein the cleaning nozzle is positioned so that the nozzle head can be inserted into the container from the opening of the container supported by the container base when the cleaning nozzle is moved by the moving means.

According to the present invention, the interior of the container can be cleaned efficiently without the contamination of the cleaning liquid caused by the mixing of the particles formed by the friction because the cleaning nozzle does not have a slidable portion anymore as the reciprocally linear movement and reciprocally rotary movement are carried out by the cleaning nozzle itself.

The above and other features and advantages of the present invention will be apparent from the following detailed description in conjunction with the accompanying drawings.

BRIEF DESCRIPTION OF DRAWINGS

In the course of the following detailed description, reference will be made to attached drawings in which.

BEST MODE FOR CARRYING OUT THE INVENTION

Figure 1:
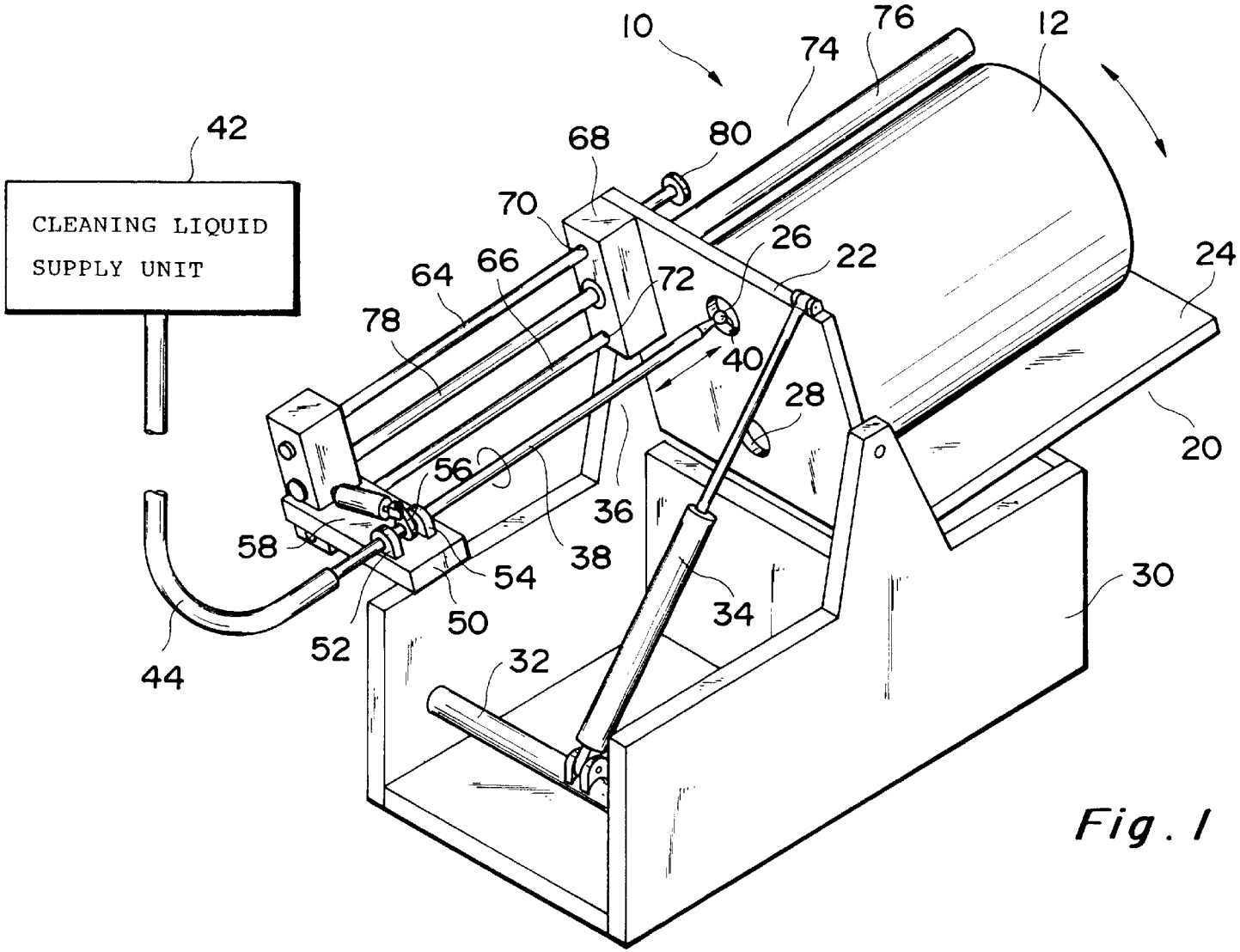
FIG. 1 is a perspective view showing a container cleaning apparatus according to the present invention.
Figure 2:
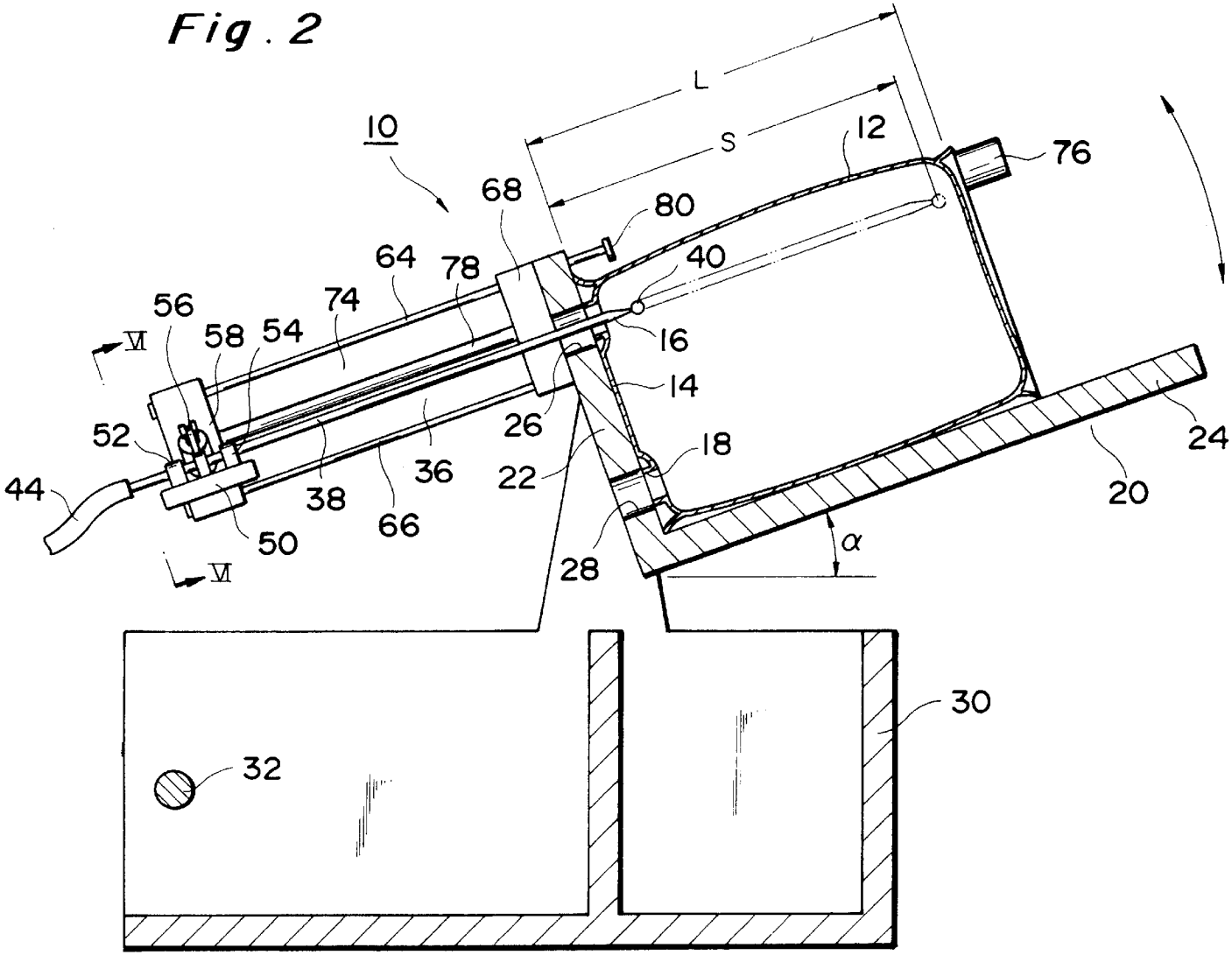
FIG. 2 is a longitudinal sectional view showing the container cleaning apparatus shown in FIG. 1.

FIGS. 1 and 2 show a container cleaning apparatus 10 according to the present invention. As shown more clearly in FIG. 2, the container cleaning apparatus 10 is used to clean a container 12 for electronic industrial chemicals. In general, this kind of container 12 is a hollow cylinder having an inner diameter of 200 mm to 600 mm and a length (height) of 300 mm to 900 mm made of stainless steel, polyethylene, Teflon or the like. Further, two openings 16 and 18 of same shape are formed near the circumference of a substantially circular upper-end plate 14 of the container 12. The openings 16 and 18 are located symmetrically against the central point of said upper-end plate 14. Usually, one of the openings is used for go infusing and discharging the liquids to be contained therein and the other is used for aiding the flowing of the air along with the infusion and discharge of the liquids.

The container cleaning apparatus 10 has a container base 20 for supporting the container 12 during cleaning. The base 20 is constituted by a first portion 22 abutting against the upper end plate 14 of the container 12, and a second portion 24 extending at the right angle from one edge of said first portion 22 to support the side surface of the container 12. Two through holes 26 and 28 are formed on the first portion 22 at a position distant from and a position close to the second portion 24, respectively. The positions of the through holes 26 and 28 are set to be in conformity with the openings 16 and 18 respectively when the container 12 having a specific size and shape for containing the electronic industrial chemicals is located at a determined position on the base 20.

The container base 20 is installed on a frame base 30 so that it can tilt between a state wherein the first portion 22 extends vertically upward and the second portion 24 is horizontal and a state wherein the first portion 22 is horizontal and the second portion 24 extends vertically upward. A pneumatic cylinder 34 is installed between the first portion 22 of the base 20 and a tie bar 32 of the frame base 30 to serve as an actuator for tilting the base 20. The pneumatic cylinder 34 is connected with a pneumatic circuit which is not shown in drawings. The pneumatic cylinder 34 expands and contracts when the supply and discharge of pressurized air to and from the pneumatic cylinder 34 are adjusted by controlling the pneumatic circuit, thereby the tilt angle of the base 20 is adjusted. The tilt angle of the base 20 mentioned here is an angle a formed by the second portion 24 of the base 20 and the horizontal plane (see FIG. 2).

The container cleaning apparatus 10 has a cleaning nozzle 36 for introducing a cleaning liquid, preferably ultra-pure water, into the container 12 supported by the base 20 and injecting it in such a manner as a jet flow. The cleaning nozzle 36 is composed of an elongated pipe 38 and a nozzle head 40 fixed to one end of said pipe 38 for injecting the ultra-pure water supplied through the pipe 38.

The outer diameter of the pipe 38 is smaller than the inner diameter of the through hole 26 and the inner diameters of the openings 16 and 18 of the container 12, so that the pipe 38 can be inserted into the container 12 through the hole 26 of the base 20 and the opening 16 of the container 12 on the base 20. The inner diameter of the pipe 38 is usually about 7 mm to 45 mm when the pressure for supplying the cleaning liquid is 0.5 to 35 kg/cm$^2$G. The entire length of the pipe 38 is preferably about 100 mm to 900 mm when the entire length of the container 12 is 300 mm to 900 mm. Further, the pipe 38 should have a certain degree of rigidity to avoid the flexion during cleaning. It is preferably made of stainless steel and the like. A flexible hose 44 extending from a cleaning liquid supply unit 42 is connected to the other end of the pipe 38. The hose 44 and the pipe 38 are preferably connected to each other directly or via a pipe joint which has no movable portions (not shown in drawings). It should be noted that the hose 44 and the pipe 38 must not be connected to each other via a pipe joint having a slidable portion like a universal joint.

Figure 3:
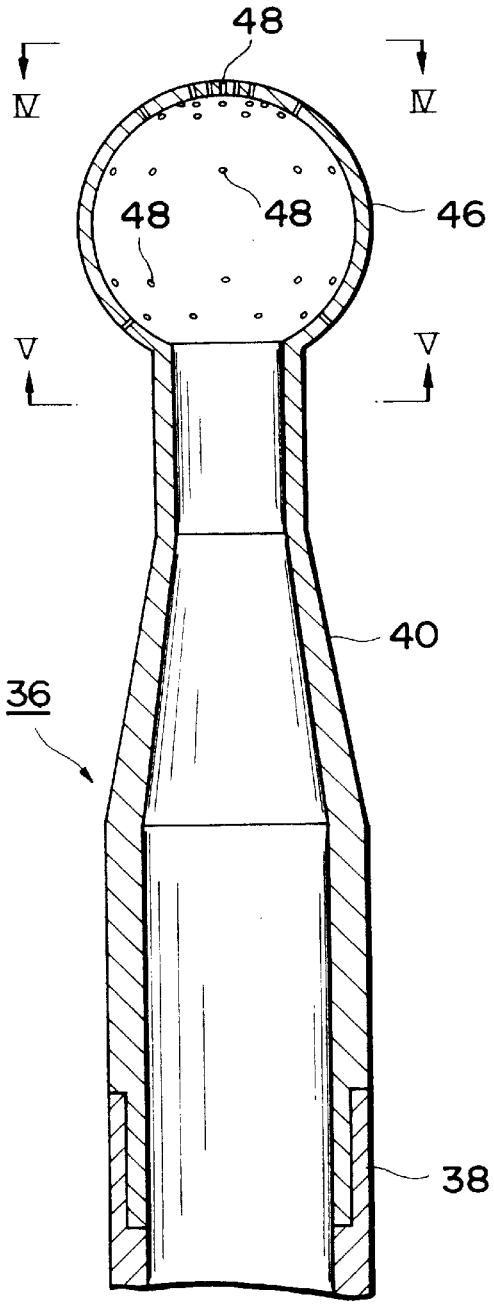
FIG. 3 is an enlarged sectional view showing a part of a cleaning nozzle used in the container cleaning apparatus of the present invention.
Figure 4:
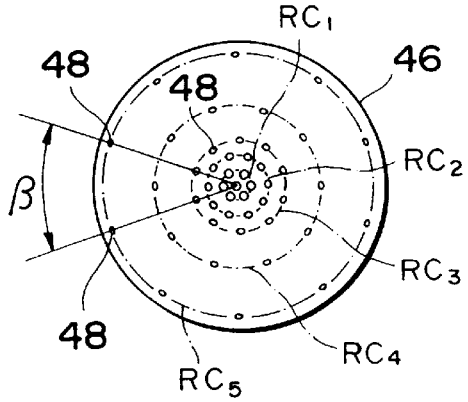
FIG. 4 is a view taken along the line IV—IV of FIG. 3 and shows the arrangement of injection holes formed at the tip of a nozzle head.
Figure 5:
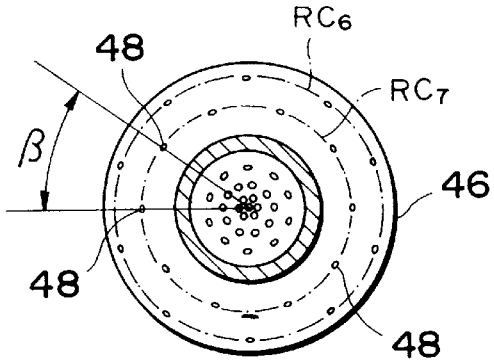
FIG. 5 is a sectional view taken along the line V—V of FIG. 3 and shows the arrangement of the injection holes formed at the tip of the nozzle head.

Numerous injection holes 48 are formed in the tip portion 46 of the nozzle head 40 for injecting preferably linear jet flows. Although the number and arrangement of injection holes 48 and the shape of the nozzle head 40 can be determined as required, a nozzle head as shown in FIGS. 3 to 5 is suitable. As best shown in FIGS. 3 to 5, the tip portion 46 of the nozzle head 40 is preferably spherical, and its outer diameter is set as smaller than the inner diameter of the through hole 26 of the base 20 and the inner diameters of the openings 16 and 18 of the container 12, so that it can be inserted together with the pipe 38 into the container 12 supported by the base 20.

As seen in FIGS. 4 and 5, the injection holes 48 are formed equidistantly along each reference circles $RC_1$ to $RC_7$ which are formed by the intersection of the outer surfaces of the nozzle heads 40 and planes extending through each of the plural points plotted on the longitudinal axis of the cleaning nozzle 36 and intersecting the axis at the right angle. The cleaning effect within a definite time and the instantaneous flow rate are increased when the angular interval between the adjacent injection holes 48, 48 of each reference circles $RC_1$ to $RC_7$, i.e., an angle $\beta$ formed by perpendiculars respectively extending from the adjacent injection holes 48, 48 to the longitudinal axis is getting small. Reversely, the cleaning effect within the definite time is decreased when the the angle $\beta$ is increased. Therefore, the angle $\beta$ is preferably 20° to 90°. Similarly, from the viewpoint of the relation of the flow rate and the cleaning effect, the number of reference circles is preferably 3 to 8. Accordingly, the total number of injection holes 48 is 30 to 100. Furthermore, for the same reason, the diameter of the injection holes 48 is preferably 0.1 mm to 2.0 mm, and more preferably 0.5 mm to 1.5 mm.

Figure 6:
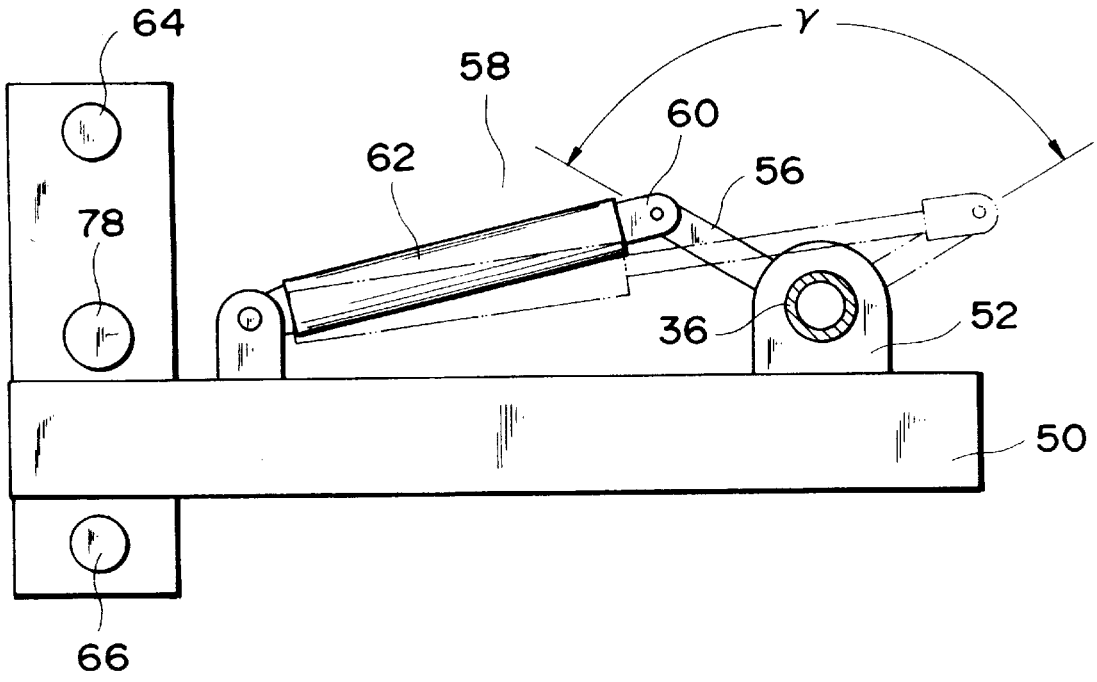
FIG. 6 is a side view of a supporting plate and its relevant members along the line VI—VI of FIG. 2, wherein other portions of the apparatus are omitted for clearness.

The end portion of the pipe 38 connecting the hose 44 is supported by a pair of bearings 52 and 54 on the support plate 50. The bearings 52 and 54 support the cleaning nozzle 36 to make the same rotatable about its longitudinal axis but unable to move in a direction along the axis. A swing arm 56 is mounted on the circumferential surface of the pipe 38 between the bearings 52 and 54. The cleaning nozzle 36 can be rotated in clockwise and counterclockwise directions alteratively when the swing arm 56 extending in a direction perpendicular to the longitudinal axis of the cleaning nozzle 36 is swung. As shown in FIG. 6, a pneumatic cylinder 58 is provided on the support plate 50 as an actuator for swinging the swing arm 56, wherein the end portion of a piston rod 60 of the pneumatic cylinder 58 is pivotally mounted on the distal end of the arm 56, and the end portion of a cylinder tube 62 is pivotally mounted on the support plate 50. In this embodiment, the arm 56 is swung within a range of about 120° by one maximum stroke of the pneumatic cylinder 58. This pneumatic cylinder 58 is connected to an appropriate pneumatic circuit (not shown in drawings) for controlling the supply and discharge of pressurized air. Accordingly, a swing angle $\gamma$ of the arm 56, and thus the rotation angle $\gamma$ of the cleaning nozzle 36, can be adjusted by controlling the pneumatic circuit.

The support plate 50 is arranged on the lower surface side of the first portion 22 of the base 20, i.e., on a side opposite to the second portion 24. Additionally, the support plate 50 has a pair of guide shafts 64 and 66 extending in the same direction as the pipe 38 of the cleaning nozzle 36 and longer than the pipe 38. These guide shafts 64 and 66 are slidably inserted in corresponding guide holes 70 and 72 of a guide block 68 at the corner portion of the first portion 22 of the base 20. Thus, the support plate 50 is supported to be reciprocally movable toward and away from the base 20. In order to move the support plate 50 reciprocally, an actuator such as a pneumatic cylinder 74 is provided. A cylinder tube 76 of the pneumatic cylinder 74 is fixed to the guide block 68 parallel to the guide holes 70 and 72, and the distal end of a piston rod 78 extending from the cylinder tube 76 is connected to the support plate 50. When the pneumatic cylinder 74 is controlled by an appropriate pneumatic circuit, the support plate 50 can be reciprocally and linearly moved in a desired stroke.

The guide holes 70 and 72 of the guide block 68 and the pneumatic cylinder 74 extend parallel to the central axis of the through hole 26 formed in the first portion 22 of the base 20. The cleaning nozzle 36 is positioned to be coaxial with the through hole 26. Accordingly, when the support plate 50 is reciprocally and linearly moved by the pneumatic cylinder 74, the cleaning nozzle 36 can be inserted in and removed from the through hole 26. It is preferable to fix stoppers 80 having enlarged diameters to the free ends of the guide shafts 64 and 66 so that the guide shafts 64 and 66 will not drop from the guide block 68.

A method of cleaning the interior of the container 12 for electronic industrial chemicals using the above-mentioned cleaning apparatus 10 is described hereafter.

Firstly, the container 12 to be cleaned is arranged on the container base 20 in such a state that the openings 16 and 18 of the upper end plate 14 of the container 12 are in conformity with the through holes 26 and 28 of the container base 20 respectively. Additionally, the container 12 is preferably fixed with a tie belt or the like for avoiding its dropping from the base 20.

Subsequently, the pneumatic cylinder 34 is actuated to tilt the container base 20 to a desired tilt angle $\alpha$. This angle $\alpha$ can be appropriately selected from the range of 0° to 90° in accordance with the shape of the container and the positions of the openings. In the case of the container 12 shown in FIG. 2, the angle a of about 20° to 70° is preferable as the opening 18 serves as the discharge port of the cleaning liquid.

Then, the pneumatic cylinder 74 is controlled for inserting the cleaning nozzle 36 into the container 12 from the lower surface side of the first portion 22 of the base 20 through the through hole 26 of the container base 20 and the opening 16 of the container 12, and ultra-pure water used as the cleaning liquid is supplied from the cleaning liquid supply unit 42 by a supply pressure of 0.5 to 35 kg/cm$^2$G, preferably 10 to 20 kg/cm$^2$G. Thus, the ultra-pure water flows through the flexible hose 44 and the pipe 38 of the cleaning nozzle 36, and is injected from the injection holes 48 of the nozzle head 40 in the form of jet flows.

When the supply of the ultra-pure water is started, the pneumatic cylinders 58 and 74 are independently controlled to rotate the cleaning nozzle 36 in clockwise and counterclockwise directions alternately within the range of a desired rotation angle $\gamma$ and to move the support plate 50 linearly and reciprocally, thereby the nozzle head 40 is moved reciprocally between the opening 16 of the container 12 and a predetermined position in the container 12.

If the only cleaning nozzle 36 is rotated in a definite direction about its longitudinal axis while the support plate 50 is not moved, the points on the inner wall surface of the container 12 struck by the jet flows from each injection holes 48 of the nozzle head 40 move circumferentialy on the inner wall surface of the container 12. If the rotation of the cleaning nozzle 36 in the definite direction is continued, the striking-point of the jet flow from one injection hole 48 against the wall surface eventually reaches the start point of the striking-point of the jet flow from the adjacent injection hole 48 on the same reference circle RC. Accordingly, no further rotation of the cleaning nozzle 36 in said direction is needed, and at this time the rotating direction of the cleaning nozzle 36 is reversed so that the jet flows are struck repeatedly against the entire inner wall surface of the container 12 at a same height level. Consequently, it is proper if the rotation angle $\gamma$ of the cleaning nozzle 36 is equal to the angular interval $\beta$ of the adjacent injection holes of the nozzle head, and preferably slightly larger than the angle $\beta$ by, e.g., about 4° as considering the processing precision of the injection holes 48.

Further, the maximum moving speed of the striking-points of jet flows against the inner wall surface of the container is preferably set to 1,000 mm/s or less based on the consideration about the cleaning effect, the flow rate of the cleaning liquid and other factors. Accordingly, the time needed for one rotation of the cleaning nozzle 36 in both clockwise and counterclockwise directions, namely, the rotation speed $T_1$ of the cleaning nozzle 36, is preferably 600 sec/cycle or less, and more preferably 120 sec/cycle or less. However, if the speed $T_1$ is excessively low, some portions of the inner wall of the container may not be struck by the ultra-pure water. Therefore, the speed $T_1$ above 20 sec/cycle is desirable.

Since the cleaning nozzle 36 is not only rotated but also moved reciprocally in the axial direction, the striking-point of each jet flow against the inner wall surface of the container moves along the longitudinal direction of the container 12 while forming a sine curve. In order to substantially cover the entire inner wall surface of the container 12 with the traces of all the jet flows, it is important for each trace to shift along with the reciprocally linear motion of the cleaning nozzle 36. This condition can be easily obtained by the simulation of a computer or the like, and preferably satisfies the following formula:

$$\Delta=2S\times T_1/T_2 \text{ (mm) } 10\leqq\Delta\leqq30$$

where $T_2$ is a time needed for one forward and backward reciprocation of the cleaning nozzle 36, namely, the speed (sec/cycle) of the reciprocal linear motion of the cleaning nozzle 36, and S is the stroke of the cleaning nozzle 36.

Further, considering the cleaning effect and the consumption flow rate of the cleaning liquid, S/L as the ratio of the stroke S of the cleaning nozzle 36 to a distance L from the opening 16 to the bottom surface of the container 12 is preferably 0.1 to 1.0 and more preferably 0.2 to 0.5.

When the cleaning is continued under the above condition, the jet flows from the nozzle head 40 strike efficiently against the entire inner wall surface of the container 12. Additionally, the secondary contamination due to the particles formed by the friction of a slidable portion is not a worry anymore since there is no slidable portion such as a rotary portion exposed to the channel of the ultra-pure water, i.e., the inner spaces of the hose 44 and the cleaning nozzle 36. Therefore, a desired cleaning effect can be obtained with a very small amount of ultra-pure water within a short period of time.

When the cleaning of the container 12 using the opening 16 is finished, the container 12 is rotated through 180° to align the opening 18 with the through hole 26 of the base 20, and a cleaning same as described above is carried out by inserting the cleaning nozzle 36 into the container through the opening 18, thereby the cleaning operation is completed. As a matter of course, the above operation can be automated by automatically controlling the pneumatic circuits connected respectively to the actuators 34, 58, and 74.

Ultra-pure water used for the cleaning is discharged to the outside through the opening 18 or 16 of the container 12 and the through hole 28 of the base 20.

The results obtained from a practical cleaning of the container using the container cleaning apparatus described above are stated hereafter.

A polyethylene container for electronic industrial chemical having a shape as shown in FIG. 2 was used as the container (12) to be cleaned. The inner diameter of the container was about 580 mm. The length (L) from the opening to the bottom surface of this container was about 900 mm. The inner diameter of the openings (16, 18) was 58 mm. The construction of employed container cleaning apparatus (10) was same as that shown in FIGS. 1 and 2. The pipe (38) of the cleaning nozzle (36) had an inner diameter of 27.2 mm and a length of 450 mm. The shape of the nozzle head (40) was substantially same as that shown in FIGS. 3 to 5. The number of injection holes (48) was 67, and the hole diameter was 0.8 mm.

The cleaning was conducted in accordance with the procedures mentioned above, wherein the rotation angle ($\gamma$) of the cleaning nozzle was set to 40°, the rotation speed ($T_1$) was set to 1.5 sec/cycle, the relation between the stroke (S) of the cleaning nozzle and the length (L) of the container was set to establish S/L=0.5,. the speed ($T_2$) of the reciprocally linear motion of the cleaning nozzle was set to 40 sec/cycle, ultra-pure water was used as the cleaning liquid, the supply flow rate of the ultra-pure water was 0.08 $m^3$/min, the supply pressure was 10 kg/$cm^2$G, and the time of the cleaning was respectively 10 minutes by using the opening (16) and the opening (18).

When the cleaning was finished, the container was filled with ultra-pure water and the concentration of the particles (particles/ml) with a diameter of 0.2 $\mu$m or more in the ultra-pure water after the lapse of an hour was measured with a particle counter employing the light scattering means.

As the results of the cleaning of four containers carried out under the conditions mentioned above, the concentrations of the particles therein are respectively 15.7, 8.3, 9.6, and 10.3, and the average thereof was 11.0.

Comparative Example 1

Cleanings of four containers were carried out under the same conditions as those of the Example described above except that the cleaning nozzle was fixed or set stationary while the nozzle head was located at a nearly central position of the container in the longitudinal direction. As a result, the particle concentrations in the containers were 49.4, 16.2, 31.7, and 23.9 respectively, and the average thereof was 30.3.

Comparative Example 2

Cleanings of four containers were performed in the same manner as the Example described above but using a conventional apparatus wherein the cleaning nozzle was composed of a pipe and a nozzle head rotatably mounted on the distal end of the pipe and the nozzle head was rotated by the fluid-pressure of ultra-pure water. As a result, the particle concentrations in the containers were 76.4, 144, 319, and 102, and their average was 160.

It is clarified by the above results that, according to the present invention, the entire inner surface of the container can be cleaned completely so that the increase of the particle concentration in the liquid when infusing and storing the liquid in the container can be maintained at a very low level. Further, according to the present invention, an efficient and economic cleaning of the interior of a container can be conducted since the flow rate of the cleaning liquid required for achieving a desired effect is small.

Figure 7:
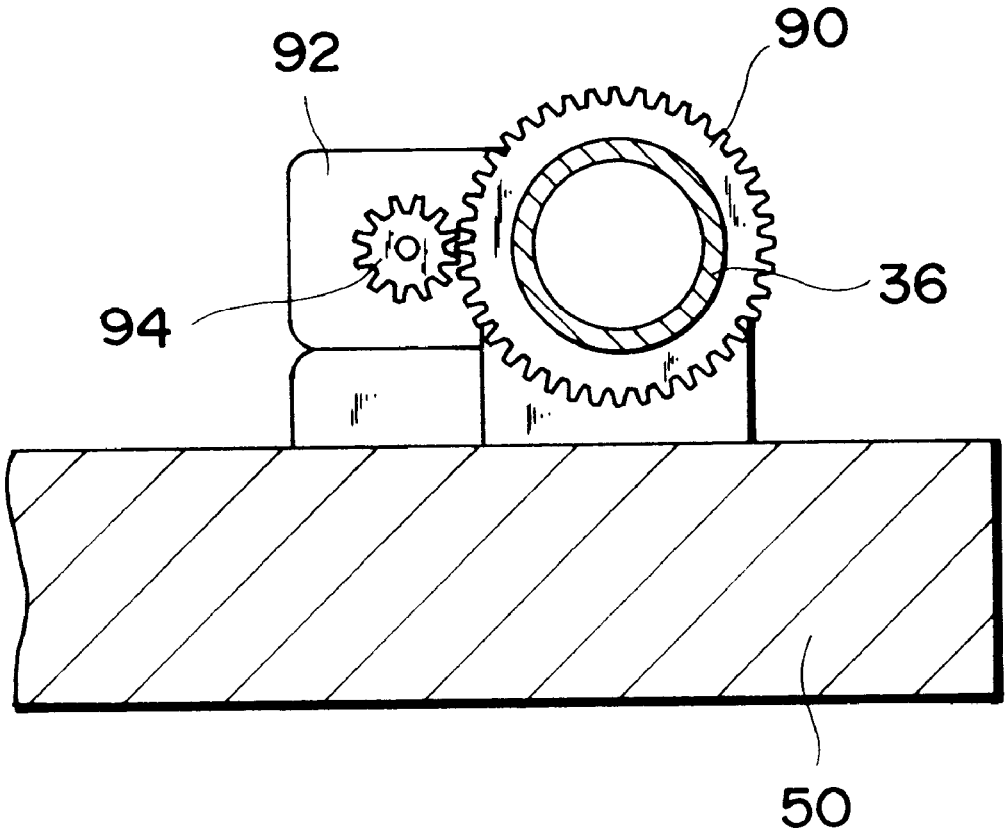
FIG. 7 is a schematic view showing the mechanism for rotating the cleaning nozzle.

A preferred embodiment of the present invention has been described above, while the present invention is not limited to the above embodiment. For example, the present invention can be applied to other forms of containers such as a container having only one opening. In the case of a cylindrical container having only one opening, only one through hole in the first portion of the base is enough, and the size and position of the through hole, the tilt angle of the base during cleaning, and other factors can be selected appropriately. Additionally, in the above embodiment, the cleaning nozzle is rotated by a link mechanism, but, as shown in FIG. 7, a gear 90 may be coaxially mounted on the outer surface of a pipe 38 of a cleaning nozzle 36, and a pinion 94 of a motor 92 may be meshed with the gear 90 to rotate the cleaning nozzle. In the construction of FIG. 7, the maximum rotation angle of the cleaning nozzle can be increased to about 360°. Furthermore, the cleaning liquid is not limited to ultra-pure water, and a liquid of the same type to be infused into the container may be used. Consequently, it is clear that the above embodiment is merely an example, and the various modifications in the shape and construction not departing from the spirit and scope of the invention can be obtained.

I claim:

1. An apparatus for cleaning an interior of a container, comprising:

a container base for supporting said container defining an opening mating with an opening defined in an end plate of said container, said openings having inner walls;

a cleaning nozzle composed of an elongated rigid pipe and a nozzle head with numerous injection holes and fixed to one end of said pipe;

moving means for translating said cleaning nozzle reciprocally along a longitudinal axis;

rotating means for rotating said cleaning nozzle about the longitudinal axis in clockwise and counterclockwise directions alternately;

said cleaning nozzle being insertable into said openings such that when said cleaning nozzle is moved by said moving means there is no frictional contact between said cleaning nozzle and said inner walls of said openings.

2. An apparatus for cleaning an interior of a container according to claim 1, further comprising a frame base for supporting said container base tiltably to make the opening of said container supported by said container base downward, and a tilting means for tilting said container base to adjust a tilt angle of said container base.

3. An apparatus for cleaning an interior of a container according to claim 1, wherein the injection holes of said nozzle head are formed at a substantially spherical tip of said nozzle head.

4. An apparatus for cleaning an interior of a container according to claim 1, wherein the hole diameter of said injection hole is 0.1 mm to 2.0 mm.

5. An apparatus for cleaning an interior of a container according to claim 1, wherein said injection holes are arranged equidistantly in the rotating direction of said nozzle about the longitudinal axis of said cleaning nozzle.

6. An apparatus for cleaning an interior of a container according to claim 5, wherein the angle ($\gamma$) of the rotation of said cleaning nozzle respectively in clockwise and counterclockwise directions is bigger than the angle ($\beta$) defined by the perpendiculars extending respectively from the injections holes adjacent to each other along the longitudinal axis of said cleaning nozzle.

7. An apparatus for cleaning an interior of a container according to claim 1, wherein the angle (γ) of the rotation of said cleaning nozzle respectively in clockwise and counterclockwise directions is 10° to 360°.

8. An apparatus for cleaning an interior of a container according to claim 1, wherein said moving means comprises a support plate mounted to be reciprocally movable against said cleaning nozzle for supporting said pipe of said cleaning nozzle, and an actuator for moving said supporting plate linearly and reciprocally.

9. An apparatus for cleaning an interior of a container according to claim 8, wherein said actuator is a pneumatic cylinder.

10. An apparatus for cleaning an interior of a container according to claim 8, wherein said rotating means comprises a bearing for rotatably supporting said cleaning nozzle on said support plate, an actuator mounted on said support plate, and a transmitting mechanism for transmitting a driving force of said actuator, thereby rotating said cleaning nozzle.

11. An apparatus for cleaning an interior of a container according to claim 10, wherein said actuator of said rotating means is a pneumatic cylinder, and said transmitting mechanism includes a swing arm fixed to an outer surface of said pipe of said cleaning nozzle.

12. An apparatus for cleaning an interior of a container according to claim 1, further comprising a cleaning liquid supply unit, and a flexible hose for conveying a cleaning liquid from said cleaning liquid supply unit, wherein said hose is directly connected to the other end of said pipe of said cleaning nozzle.

13. An apparatus for cleaning an interior of a container, comprising:

a container base for supporting said container defining an opening mating with an opening defined in an end plate of said container, said openings having inner walls;

a cleaning nozzle composed of an elongated rigid pipe and a nozzle head with numerous injection holes and fixed to one end of said pipe;

a moving mechanism secured to the container base and associated with said cleaning nozzle, said moving mechanism having structure constructed and arranged to translate said cleaning nozzle reciprocally along a longitudinal axis;

a rotating mechanism having structure constructed and arranged to rotate said cleaning nozzle alternately in clockwise and counterclockwise directions about the longitudinal axis;

said cleaning nozzle being insertable into said openings such that when said cleaning nozzle is moved by said moving means there is no frictional contact between said cleaning nozzle and said inner walls of said openings.

* * * * *